US007481614B2

(12) United States Patent
Tomita et al.

(10) Patent No.: US 7,481,614 B2
(45) Date of Patent: Jan. 27, 2009

(54) MOVING BLADE AND GAS TURBINE USING THE SAME

(75) Inventors: Yasuoki Tomita, Takasago (JP); Masaki Ono, Takasago (JP); Eiji Akita, Takasago (JP); Masao Terazaki, Takasago (JP); Masayuki Takahama, Takasago (JP); Kouji Watanabe, Takasago (JP); Hideki Murata, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 539 days.

(21) Appl. No.: 11/059,644

(22) Filed: Feb. 17, 2005

(65) Prior Publication Data

US 2005/0186074 A1 Aug. 25, 2005

(30) Foreign Application Priority Data

Feb. 23, 2004 (JP) ..... 2004-045683

(51) Int. Cl.
*F01D 5/14* (2006.01)

(52) U.S. Cl. ..... 415/115; 416/239; 416/243

(58) Field of Classification Search ..... 416/239; 415/115

See application file for complete search history.

(56) References Cited

U.S. PATENT DOCUMENTS 2,912,223 A * 11/1959 Hull, Jr. ..... 416/221
3,266,770 A * 8/1966 Harlow ..... 416/92
3,527,543 A * 9/1970 Howald ..... 416/90 R
3,902,820 A * 9/1975 Amos ..... 416/97 R
3,950,113 A * 4/1976 Albrecht ..... 416/97 A
4,076,436 A * 2/1978 Slator et al. ..... 403/343
4,548,531 A * 10/1985 Seitelman et al. ..... 409/9
4,917,574 A * 4/1990 Dodd et al. ..... 416/193 A
6,086,329 A * 7/2000 Tomita et al. ..... 416/193 A
6,171,058 B1 1/2001 Stec
6,174,135 B1 1/2001 Lee
6,190,128 B1 * 2/2001 Fukuno et al. ..... 416/96 R
6,390,775 B1 5/2002 Paz

FOREIGN PATENT DOCUMENTS

JP 64-63605 3/1989

(Continued)

OTHER PUBLICATIONS

Korean Office Action dated Mar. 23, 2007, Application No. 10-2005-0006208.

(Continued)

*Primary Examiner*—Edward Look
*Assistant Examiner*—Aaron R Eastman
(74) *Attorney, Agent, or Firm*—Westerman, Hattori, Daniels & Adrian, LLP.

(57) ABSTRACT

In a gas turbine having a plurality of moving blades provided on a rotary shaft in a circumferentially adjoining condition, a seal pin is provided in a spacing between the shanks of the adjacent moving blades for preventing leakage of cooling air from a blade root portion side to an airfoil side; an arcuately depressed portion is formed on the shank of each of the moving blades; and vibration of each of the moving blades is suppressed in such a manner that the seal pin serves as a spring system while the airfoil portion, the platform, the shank, and the blade root portion serve as a mass system.

16 Claims, 8 Drawing Sheets

FOREIGN PATENT DOCUMENTS

| | | | |
|---|---|---|---|
| JP | 09-303107 | A | 11/1997 |
| JP | 11-022404 | A | 1/1999 |
| JP | 2000-291407 | A | 10/2000 |
| JP | 2000-345805 | A | 12/2000 |
| JP | 2002-129905 | | 5/2002 |
| JP | 2002-129905 | A | 5/2002 |
| JP | 2002-213205 | A | 7/2002 |

OTHER PUBLICATIONS

Japanese Office Action issued on Sep. 30, 2008 for corresponding Japanese Patent Application No. 2004-045683.

* cited by examiner

MOVING BLADE AND GAS TURBINE USING THE SAME

CROSS REFERENCE TO RELATED APPLICATION

The entire disclosure of Japanese Patent Application No. 2004-045683 filed on Feb. 23, 2004, including specification, claims, drawings and summary, is incorporation herein by reference in its entirety.

BACKGROUND OF THE INVENTION

1. Field of the Invention

The present invention relates to a moving blade and to a gas turbine using the moving blade.

2. Description of the Related Art

In a gas turbine, a plurality of disks are arranged in the axial direction of a rotary shaft, and in the circumference of each of the disks a plurality of moving blades are circumferentially embedded adjacent to each other. Stationary vanes provided on a casing, which covers the moving blades, are arranged between adjacent rows of moving blades. A high-temperature combustion gas flows over the moving blades and the stationary vanes, to thereby rotatively drive the moving blades. Accordingly, the rotary shaft is rotated to thereby drive, for example, a compressor and a power generator.

Since high-temperature combustion gas is introduced into the gas turbine, the moving blades and the stationary vanes are exposed to high temperature. In order to cope with high temperature, the moving blade assumes the form of a cooled blade in which cooling medium flow paths are formed (as disclosed in, for example, Japanese Patent Application Laid-Open (kokai) Nos. 2002-129905 and H01-63605).

When the rotary shaft of the gas turbine is rotatively driven, the disks provided on the rotary shaft are rotatively driven. At this time, a row of moving blades moves between adjacent rows of stationary vanes provided on the casing, which is disposed around the rotary shaft. When high-temperature combustion gas flows over the moving blades and the stationary vanes, vortexes are generated at trailing ends of the blades and vanes. The vortexes cause a force to act on the blades and vanes in such a manner as to press the blades and vanes toward the front and rear of the gas turbine and toward the respectively adjacent blades and vanes. As a result, the blades and vanes vibrate.

The conventional moving blades have been found to involve the following problem. When the natural frequency of the stationary vanes disposed on the casing coincides with the natural frequency of the moving blades, the moving blades and the stationary vanes resonate, and the magnitude of vibrations of the blades and vanes increases. As a result, high cycle fatigue (HCF) potentially arises in the moving blades and the stationary vanes.

SUMMARY OF THE INVENTION

In view of the foregoing, an object of the present invention is to provide a moving blade whose vibration is suppressed, as well as a gas turbine using the same.

To achieve the above object, a moving blade of the present invention comprises an airfoil portion to be exposed to high-temperature gas; a platform for supporting the airfoil portion; a shank extending downward from the platform; a blade root portion extending downward from the shank and to be embedded in a rotary shaft; and a cooling air flow path extending through the blade root portion, the shank, the platform, and the airfoil portion for channeling cooling air. In the moving blade, an arcuately depressed portion is formed on the shank.

By virtue of the above configuration, strength distribution in the shank becomes uniform. Thus, while the shank maintains fixed strength, stress induced by exposure to high-temperature gas and vibration of the moving blade can be dispersed uniformly in accordance with the strength distribution, thereby suppressing concentration of the stress on the shank.

Preferably, in the moving blade of the present invention, the arcuately depressed portion extends from the lower end of the platform to the blade root portion.

By virtue of the above formation of the arcuately depressed portion, strength distribution in the shank becomes uniform along the direction extending from the lower end of the platform to the blade root portion. Thus, stress induced by exposure to high-temperature gas and vibration of the moving blade can be dispersed uniformly in accordance with the strength distribution along the direction extending from the lower end of the platform to the blade root portion, thereby suppressing concentration of the stress on the shank.

Preferably, in the moving blade of the present invention, the arcuately depressed portion extends from a leading end of the shank to a trailing end of the shank.

By virtue of the above formation of the arcuately depressed portion, strength distribution in the shank becomes uniform along the direction extending from the leading end of the shank to the trailing end of the shank. Thus, stress induced by exposure to high-temperature gas and vibration of the moving blade can be dispersed uniformly in accordance with the strength distribution along the direction extending from the leading end of the shank to the trailing end of the shank, thereby suppressing concentration of the stress on the shank.

Preferably, in the moving blade of the present invention, the depth of the arcuately depressed portion is greatest at a central portion of the shank.

By virtue of the above formation of the arcuately depressed portion, strength distribution in the shank becomes uniform. Thus, stress induced by exposure to high-temperature gas and vibration of the moving blade can be dispersed uniformly in accordance with the strength distribution, thereby suppressing concentration of the stress on the shank.

Preferably, in the moving blade of the present invention, the arcuately depressed portion is formed on the same side as the concave pressure side of the airfoil portion.

By virtue of the above formation of the arcuately depressed portion, the profile of the moving blade can be readily designed while maintaining compatibility in position between the arcuately depressed portion and the routing of the cooling air flow path, so that the cost of manufacture can be reduced.

Preferably, in the moving blade of the present invention, a portion of the shank opposite the arcuately depressed portion is located on the inside of a straight line extending in contact with a side end of the platform and a side end of the blade root portion.

The above structural feature allows the moving blades to be arranged adjacent to each other without interference of their shanks.

Preferably, in the moving blade of the present invention, a lower portion of the shank is rendered flat.

Provision of the flat lower portion of the shank frees a lower portion of the shank from variation in strength and thus allows the shank to readily have fixed strength. Therefore, stress induced by centrifugal force associated with rotation of the moving blade can be prevented from concentrating on the shank.

Preferably, in the moving blade of the present invention, an edge of the leading end and an edge of the trailing end of the shank on a side where the arcuately depressed portion is formed are chamfered.

By virtue of the above chamfering, variation in strength is reduced at the leading and trailing ends, thereby mitigating local tensile stress induced, at the edge of the leading end and the edge of the trailing end on the side where the arcuately depressed portion is formed, by exposure to high-temperature gas and vibration of the moving blade.

To achieve the above object, a gas turbine of the present invention comprises a plurality of moving blades of the present invention. The moving blades are arranged in a circumferentially adjoining condition on the circumference of each of disks arranged axially on a rotary shaft.

By virtue of the above arrangement of the moving blades, strength distribution in the shank of each of the moving blades becomes uniform. Thus, stress induced by vibration of the moving blade can be dispersed uniformly in accordance with the strength distribution, thereby suppressing concentration of the stress on the shank.

To achieve the above object, a gas turbine of the present invention comprises a plurality of moving blades mounted on a rotary shaft in a circumferentially adjoining condition. Each of the moving blades comprises an airfoil portion to be exposed to high-temperature gas; a platform for supporting the airfoil portion; a shank extending downward from the platform; a blade root portion extending downward from the shank and to be embedded in the rotary shaft; and a cooling air flow path extending through the blade root portion, the shank, the platform, and the airfoil portion for channeling cooling air. In the gas turbine, a seal pin is provided in a spacing between the shanks of the adjacent moving blades for preventing leakage of cooling air from a blade root portion side to an airfoil side; an arcuately depressed portion is formed on the shank of each of the moving blades; and vibration of each of the moving blades is suppressed in such a manner that the seal pin serves as a spring system while the airfoil portion, the platform, the shank, and the blade root portion serve as a mass system.

By virtue of the above configuration, the moving blades function as respective dampers so as to prevent coincidence between the natural frequency of the moving blades and that of stationary vanes, thereby preventing resonance of the moving blades and the stationary vanes.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

Figure 1:
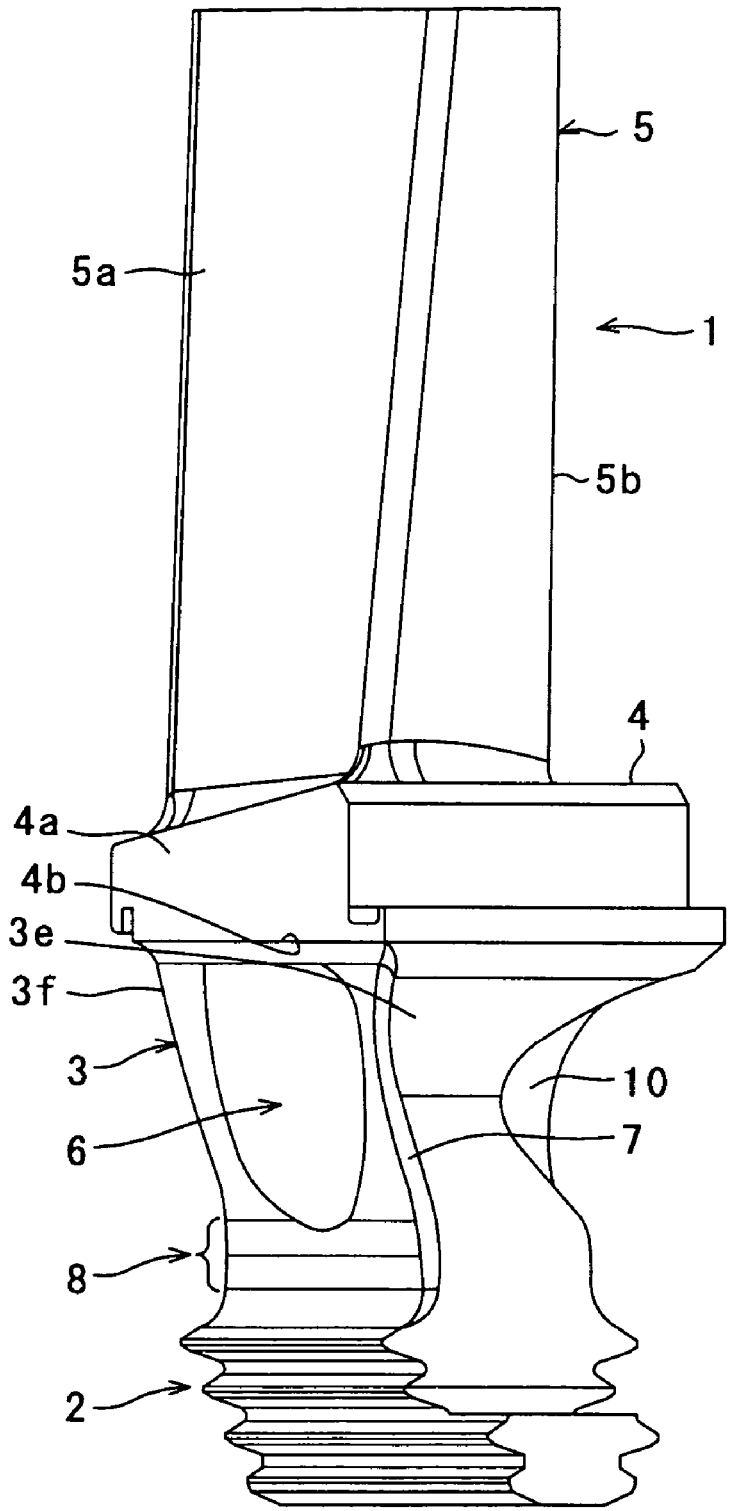
FIG. 1 is a perspective view of a gas turbine moving-blade according to an embodiment of the present invention, as viewed from the leading-end side.

An embodiment of the present invention will next be described in detail with reference to the drawings. In the drawings, the arrow "Flow" indicates the flowing direction of combustion gas.

A gas turbine includes a compressor, a combustor, and a turbine. Compressed air discharged from the compressor and fuel are mixedly combusted in the combustor so as to generate combustion gas. The thus-generated combustion gas is introduced into the turbine to thereby drive the turbine. The turbine powers the compressor as well as the generator for generating electricity.

Rows of gas turbine moving-blades 1 shown in FIGS. 1 to 5 are provided axially on a rotary shaft of the turbine. The gas turbine moving-blade 1 includes a Christmas-tree-type blade root portion 2, which is embedded in the rotary shaft of the turbine. The gas turbine moving-blade 1 further includes an airfoil portion 5, which is exposed to high-temperature gas; a platform 4, which supports the airfoil portion 5; and a shank 3, which connects the platform 4 and the blade root portion 2. The blade root portion 2 is embedded in an unillustrated disk to thereby support the gas turbine moving-blade 1.

Figure 2:
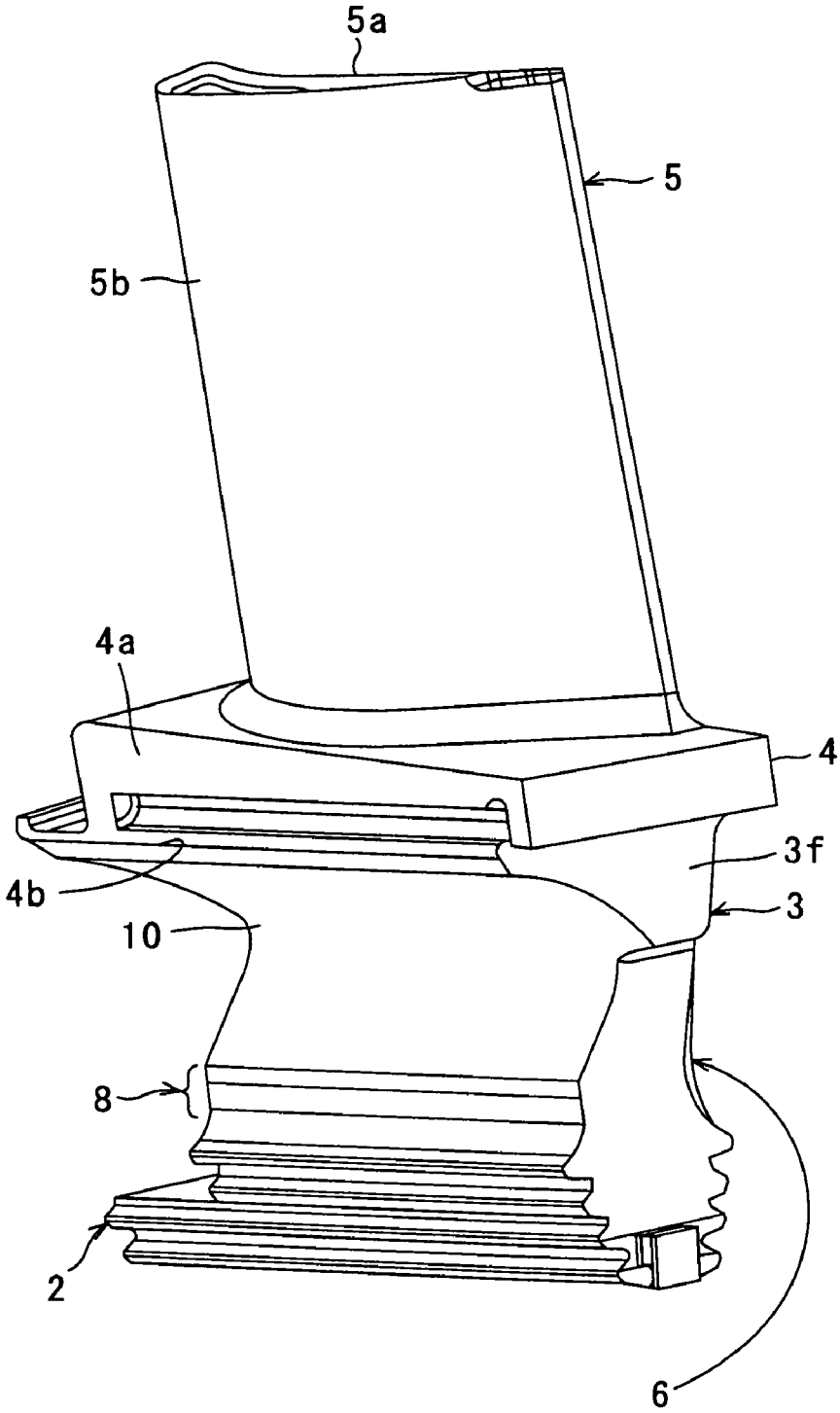
FIG. 2 is a perspective view of the gas turbine moving-blade of the embodiment as viewed from the trailing-end side.

As shown in FIGS. 1 and 2, an arcuately depressed portion 6 is formed on the shank 3 of the gas turbine moving-blade 1 on the same side (first side) as a concave pressure side 5*a* of the airfoil portion 5. A curved surface 10 is formed on the shank 3 on the side opposite the arcuately depressed portion 6; i.e., on the same side (second side) as a convex suction side 5*b* of the airfoil portion 5, in such a manner as to be concave toward the first side of the shank 3. By virtue of formation of the arcuately depressed portion 6 at such a position, the profile of the moving blade can be readily designed while maintaining compatibility in position between the arcuately depressed portion 6 and the routing of the cooling air flow path (which will be described later), so that the cost of manufacture can be reduced. A flat portion 8 is formed on the shank 3 below each of the arcuately depressed portion 6 and the curved surface 10. Provision of the flat lower portions 8 at such positions frees a lower portion of the shank 3 from variation in strength and thus allows the shank 3 to readily have fixed strength. Therefore, stress induced by centrifugal force associated with rotation of the gas turbine moving-blade 1 can be prevented from concentrating on the shank 3.

Figure 3:
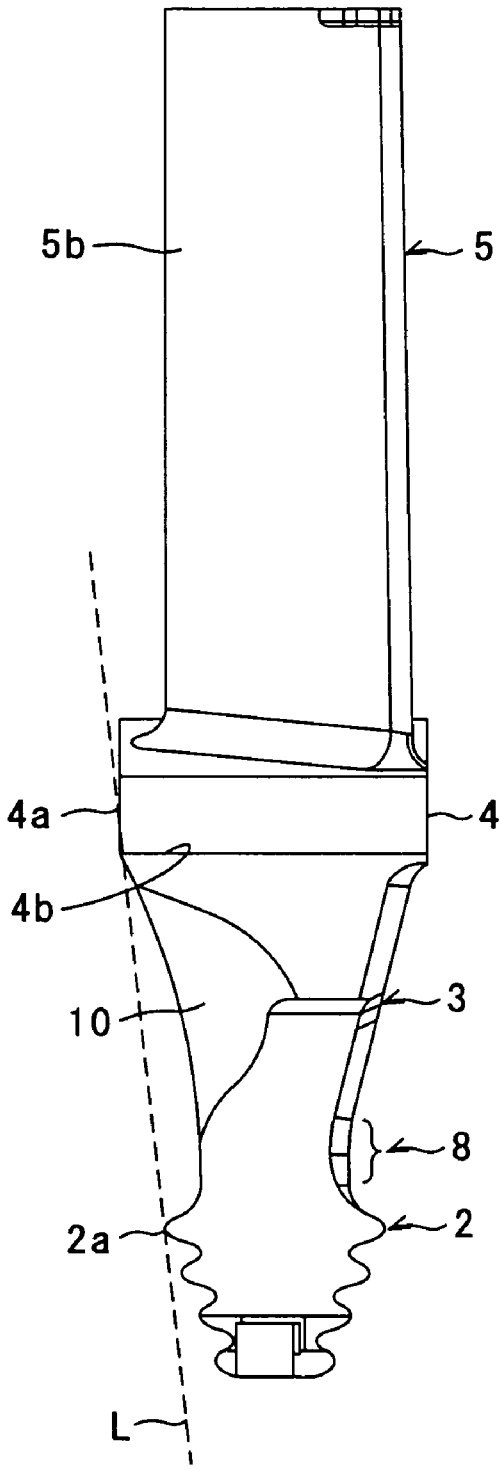
FIG. 3 is a side view of the gas turbine moving-blade of the embodiment as viewed from the trailing-end side.

An edge of a leading end 3*e* and an edge of a trailing end 3*f* on the first side of the shank 3 on which the arcuately depressed portion 6 is formed are chamfered into respective chamfered portions 7. By virtue of formation of the chamfered portions 7 at such positions, variation in strength is reduced at the leading end 3*e* and the trailing end 3*f*, thereby mitigating local tensile stress induced, at the edge of the leading end 3*e* and the edge of the trailing end 3*f*, by exposure to high-temperature gas and vibration of the moving blade 1. As shown in FIG. 3, the curved surface 10 of the shank 3 located opposite the arcuately depressed portion 6 is located on the inside of a straight line L extending in contact with a side wall 4*a*, or a side end, of the platform 4 and a side wall 2*a*, or a side end, of the blade root portion 2. Provision of the curved surface 10 at such a position prevents interference of the shanks 3 of the adjacent gas turbine moving-blades 1.

The profile of the shank 3 will be described in detail.

Figure 4A:
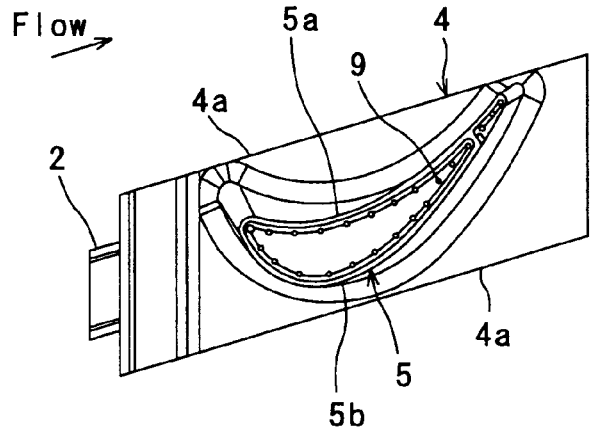
FIGS. 4A and 4B are a plan view and a side view, respectively, of the gas turbine moving-blade of the embodiment.
Figure 4B:
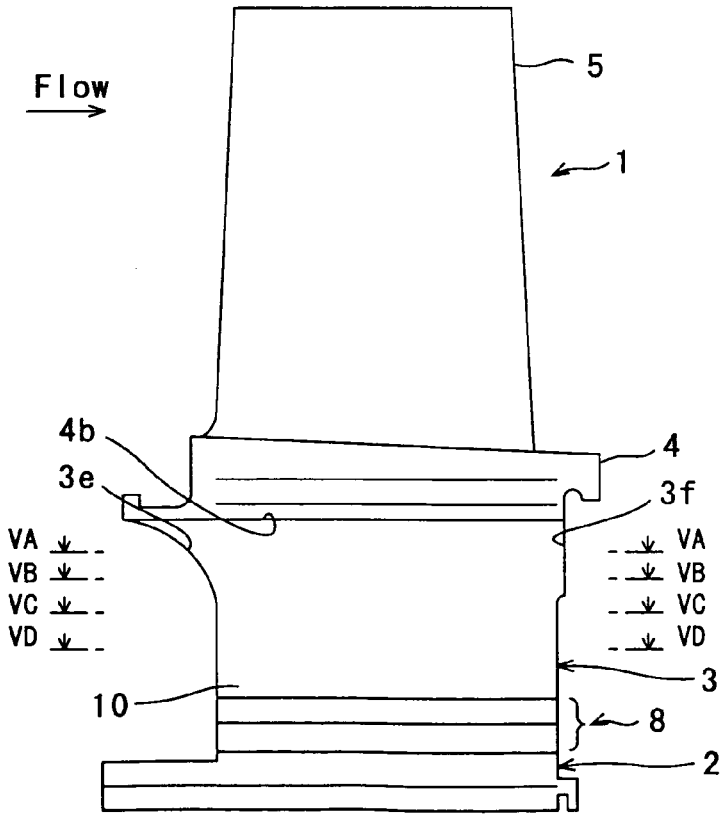
Figure 5A:
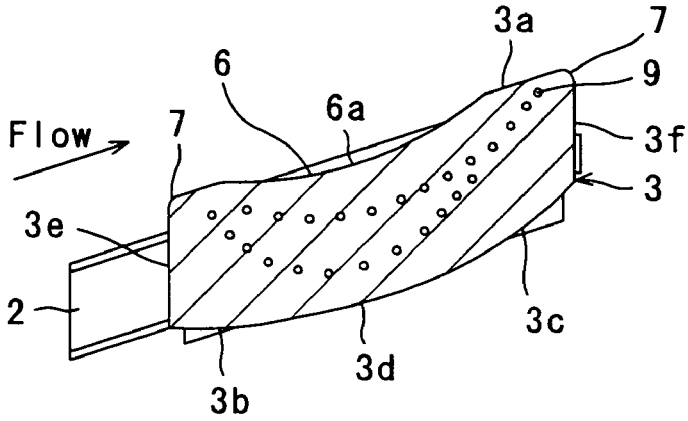
FIGS. 5A, 5B, 5C, and 5D are sectional views of the shank of the gas turbine moving-blade of the embodiment taken along lines VA-VA, VB-VB, VC-VC, and VD-VD, respectively, of FIG. 4B.

As shown in FIGS. 4 and 5A, an arcuately depressed portion 6*a* is formed at an upper portion of the shank 3 on the same side as the concave pressure side 5*a* of the airfoil portion 5; in other words, at a central portion of a first surface 3*a* on the first side of the shank 3. The arcuately depressed portion 6*a* is convex toward a second surface 3*b*, a third surface 3*c*, and a fourth surface 3*d* on the second side of the shank 3. The arcuately depressed portion 6*a* extends from the leading end 3*e* to the trailing end 3*f* of the shank 3. A counter portion of the second side of the shank 3 has an arcuately curved surface which is concave toward the first surface 3*a* and whose central portion is truncated by a plane. Specifically, the counter portion of the second side of the shank 3 includes the arcuately curved second and third surfaces 3*b* and 3*c* and the flat fourth surface 3*d*, which is continuously sandwiched between the second and third surfaces 3*b* and 3*c*. The first surface 3*a*, the second surface 3*b*, the third surface 3*c*, and the fourth surface 3*d* are located on the inside of the straight line L (FIG. 3) extending in contact with the side wall 4*a*, or a side end, of the platform 4 and the side wall 2*a*, or a side end, of the blade root portion 2.

Figure 5B:
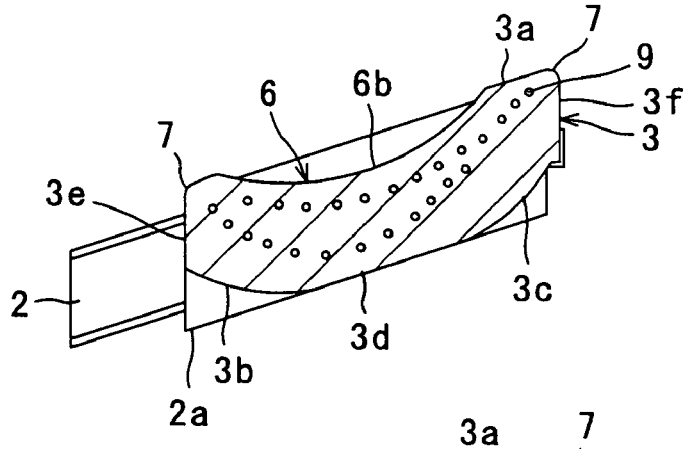

As shown in FIGS. 4 and 5(B), the horizontal section of the shank 3 taken at a level slightly above the center level of the shank 3 assumes a shape resembling the shape of a horizontal section of the airfoil portion 5 provided on the platform 4. Specifically, an arcuately depressed portion 6*b* is formed at a central portion of the first surface 3*a* on the first side of the shank 3. The arcuately depressed portion 6*b* is convex toward the second surface 3*b*, the third surface 3*c*, and the fourth surface 3*d* on the second side of the shank 3. The arcuately depressed portion 6*b* extends from the leading end 3*e* to the trailing end 3*f* of the shank 3. The arcuately depressed portion 6*b* is depressed more than the arcuately depressed portion 6*a* located thereabove. A counter portion of the second side of the shank 3 has an arcuately curved surface which is concave toward the first side and whose central portion is truncated by a plane. Specifically, the counter portion of the second side of the shank 3 includes the arcuately curved second and third surfaces 3*b* and 3*c* and the flat fourth surface 3*d*, which is continuously sandwiched between the second and third surfaces 3*b* and 3*c*. The first surface 3*a*, the second surface 3*b*, and the third surface 3*c* are located on the inside of the straight line L (FIG. 3) extending in contact with the side wall 4*a*, or a side end, of the platform 4 and the side wall 2*a*, or a side end, of the blade root portion 2. The fourth surface 3*d* is aligned with the side wall 2*a* of the blade root portion 2 and the platform 4.

Figure 5C:
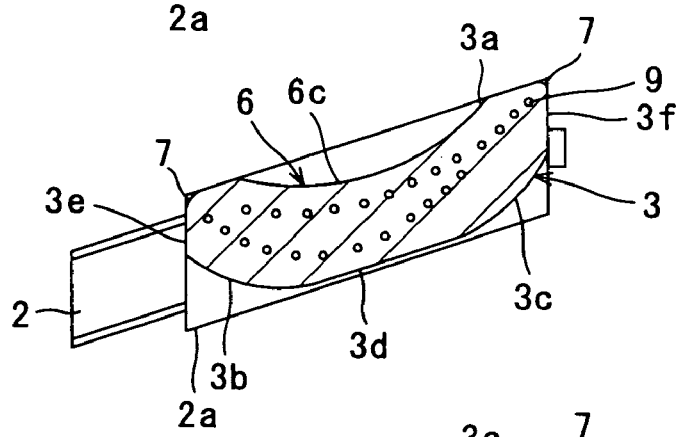

As shown in FIGS. 4 and 5C, the horizontal section of the shank 3 taken at the central level of the shank 3 assumes a shape resembling the shape of a horizontal section of the airfoil portion 5 provided on the platform 4. Specifically, an arcuately depressed portion 6*c* is formed at a central portion of the first surface 3*a* on the first side of the shank 3. The arcuately depressed portion 6*c* is convex toward the second surface 3*b*, the third surface 3*c*, and the fourth surface 3*d* on the second side of the shank 3. The arcuately depressed portion 6*c* extends from the leading end 3*e* to the trailing end 3*f* of the shank 3. The arcuately depressed portion 6*c* is depressed more than the arcuately depressed portion 6*b* located thereabove. A counter portion of the second side of the shank 3 has an arcuately curved surface which is concave toward the first side and whose central portion is truncated by a plane. Specifically, the counter portion of the second side of the shank 3 includes the arcuately curved second and third surfaces 3*b* and 3*c* and the flat fourth surface 3*d*, which is continuously sandwiched between the second and third surfaces 3*b* and 3*c*. The first surface 3*a*, the second surface 3*b*, the third surface 3*c*, and the fourth surface 3*d* are located on the inside of the straight line L (FIG. 3) extending in contact with the side wall 4*a*, or a side end, of the platform 4 and the side wall 2*a*, or a side end, of the blade root portion 2.

Figure 5D:
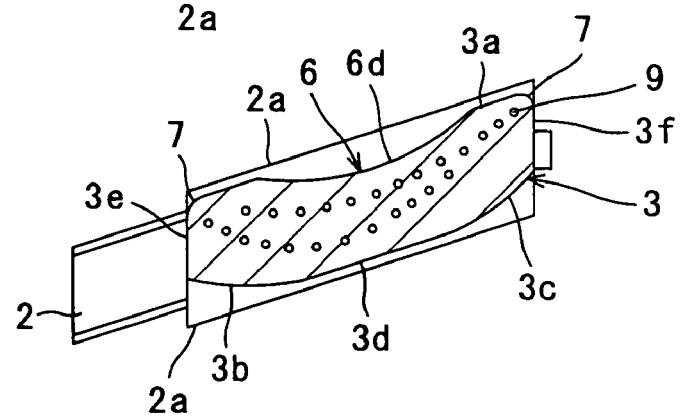

As shown in FIGS. 4 and 5D, the horizontal section of the shank 3 taken at a level slightly below the center level of the shank 3 assumes a shape resembling the shape of a horizontal section of the platform 4 taken at its central level. Specifically, an arcuately depressed portion 6*d* is formed at a central portion of the first surface 3*a* on the first side of the shank 3. The arcuately depressed portion 6*d* is convex toward the second surface 3*b*, the third surface 3*c*, and the fourth surface 3*d* on the second side of the shank 3. The arcuately depressed portion 6*d* extends from the leading end 3*e* to the trailing end 3*f* of the shank 3. The arcuately depressed portion 6*d* is depressed less than the arcuately depressed portion 6*c* located thereabove. A counter portion of the second side of the shank 3 has an arcuately curved surface which is concave toward the first side and whose central portion is truncated by a plane. Specifically, the counter portion of the second side of the shank 3 includes the arcuately curved second and third surfaces 3*b* and 3*c* and the flat fourth surface 3*d*, which is continuously sandwiched between the second and third surfaces 3*b* and 3*c*. The first surface 3*a*, the second surface 3*b*, the third surface 3*c*, and the fourth surface 3*d* are located on the inside of the straight line L (FIG. 3) extending in contact with the side wall 4*a*, or a side end, of the platform 4 and the side wall 2*a*, or a side end, of the blade root portion 2.

As shown in FIGS. 1 to 5, the arcuately depressed portion 6 is formed while extending from an upper portion of the shank 3 (the lower end 4*b* of the platform 4) to a level located below the central level of the shank 3. In other words, the arcuately depressed portion 6 extends from a lower end 4*b* of the platform 4 to the blade root portion 2. The arcuately depressed portion 6*c* is depressed most at the central level of the shank 3. Even so, the shank 3 has strength to connect the blade root portion 2 and the platform 4 and to support the platform 4.

Accordingly, the arcuately depressed portion 6 is formed in such a manner as to extend from the lower end 4*b* of the platform 4 to the blade root portion 2 and to be depressed most at the central level of the shank 3. Also, the arcuately depressed portion 6 is formed in such a manner as to extend from the leading end 3*e* to the trailing end 3*f* of the shank 3 and to be depressed most at the center of the shank 3 with respect to the direction. By virtue of the above-mentioned profile of the shank 3, strength distribution in the shank 3 becomes uniform. Thus, stress induced by exposure to high-temperature gas and vibration of the gas turbine moving-blade 1 can be dispersed uniformly in accordance with the strength distribution along the direction extending from the lower end 4*b* of the platform 4 to the blade root portion 2 and along the direction extending from the leading end 3*e* of the shank 3 to the trailing end 3*f* of the shank 3, thereby suppressing concentration of the stress on the shank 3. By virtue of the feature that the depth of the arcuately depressed portion 6*c* is the greatest at a central portion of the shank 3, strength distribution in the shank 3 becomes uniform. Thus, stress induced by exposure to high-temperature gas and vibration of the gas turbine moving-blade 1 can be dispersed uniformly in accordance with the strength distribution, thereby suppressing concentration of the stress on the shank 3.

The gas turbine moving-blade 1 is formed from a columnar-crystalline-Ni-based heat-resistant alloy that contains Cr, Co, and the like (refer to Japanese Patent No. 3246377).

Figure 6:
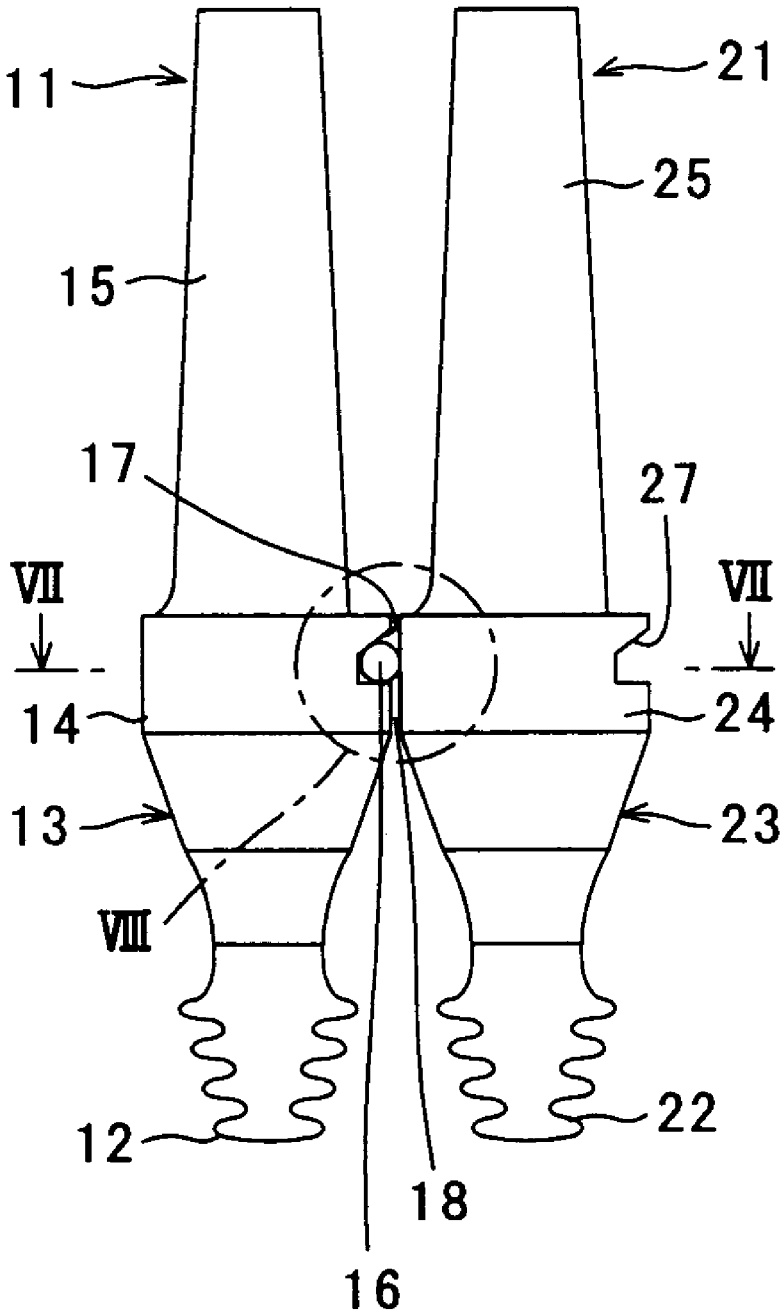
FIG. 6 is a side view showing the adjacent gas turbine moving-blades of the embodiment.
Figure 7:
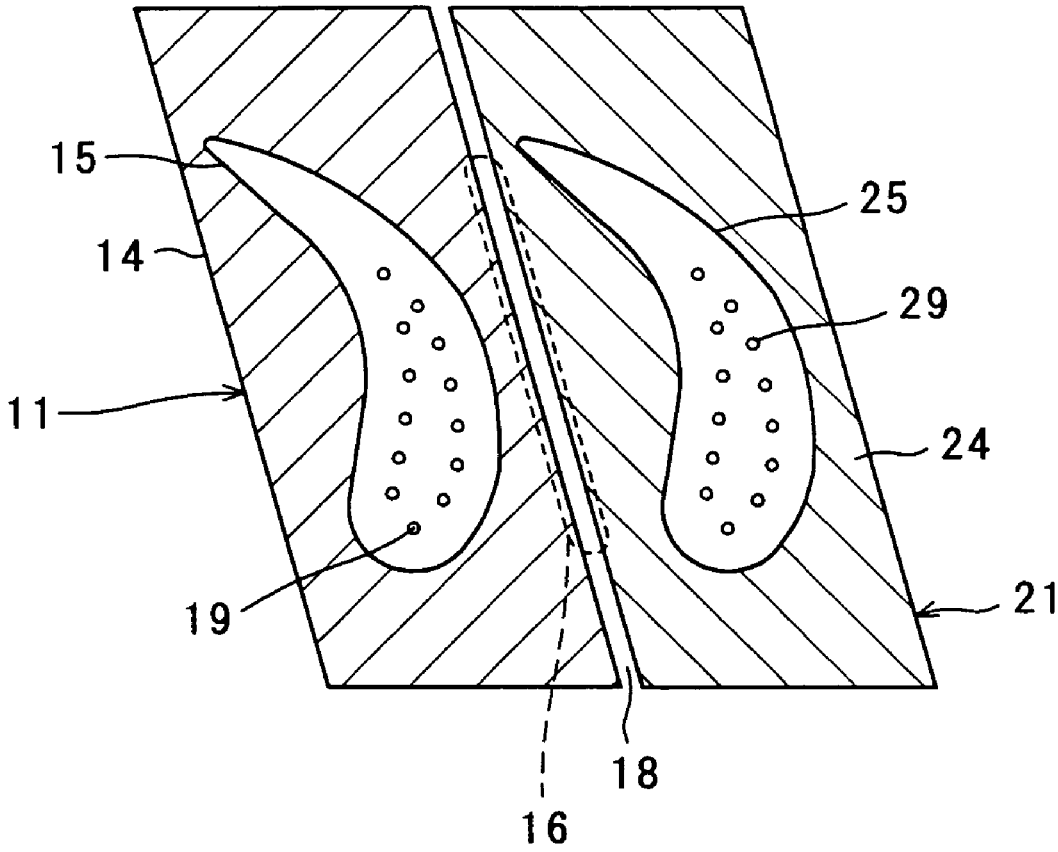
FIG. 7 is a sectional view taken along line VII-VII of FIG. 6.
Figure 8:
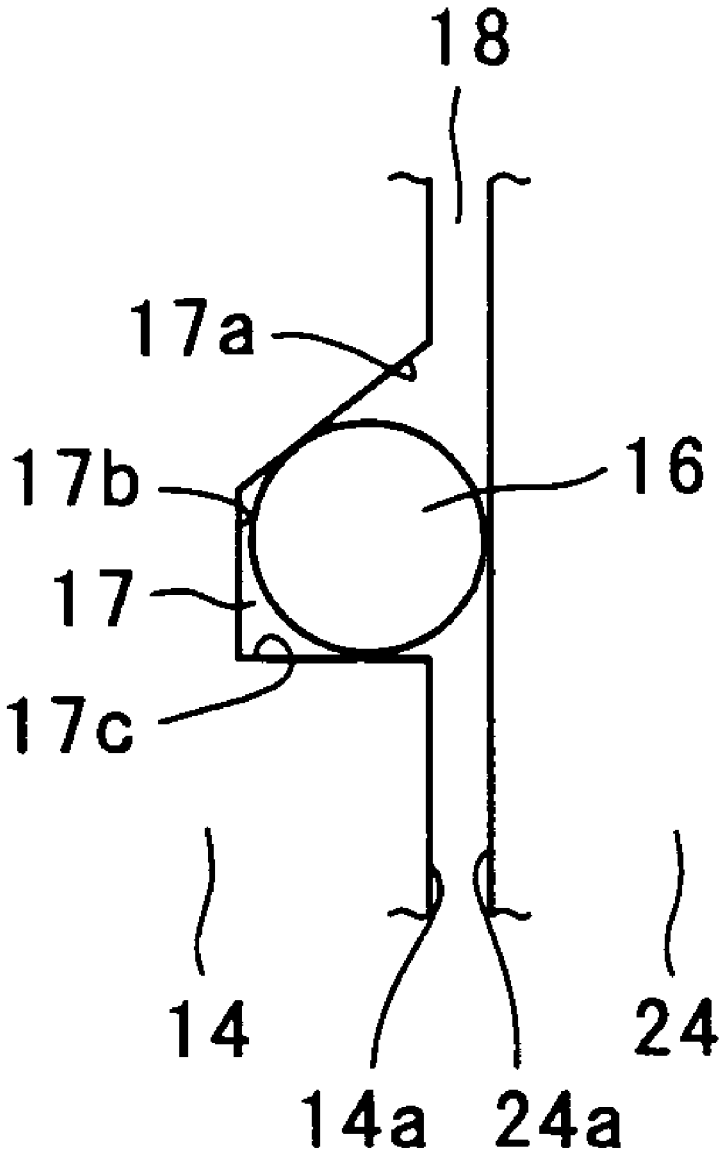
FIG. 8 is an enlarged view of essential portions encircled by line VIII of FIG. 6.

A plurality of the gas turbine moving-blades 1 having the above profile are circumferentially disposed adjacent to each other, on the circumference of a disk disposed in a gas turbine, while a spacing 18 is formed between the adjacent gas turbine moving-blades 1 as shown in FIGS. 6 to 8. A plurality of holes (denoted by reference numerals 19 and 29 in FIG. 7), which serve as cooling air flow paths, are provided in the airfoil portion 5 of the gas turbine moving-blade 1 while being arranged at predetermined intervals and running in parallel with each other. The holes are located a predetermined distance inboard from the side surface of the airfoil portion 5. A cooling medium; specifically, cooling air, flows through the holes for cooling the gas turbine moving-blade 1.

As shown in FIGS. 4 and 5, a plurality of holes 9 are provided in the gas turbine moving-blade 1. The holes 9 serve as cooling air flow paths through which a cooling medium; specifically, cooling air, flows for cooling the airfoil portion 5 of the gas turbine moving-blade 1. The holes 9 extend from the blade root portion 2 to the airfoil portion 5 through the shank 3 and the platform 4. In order to enhance the effect of cooling the airfoil portion 5, the holes 9 are located a predetermined distance inboard from the side surface of the airfoil portion S. In other words, the holes 9 are arranged along a geometry resembling the cross-sectional shape, on a reduced scale, of the airfoil portion 5. In order to efficiently channel cooling air from the blade root portion 2 to the airfoil portion 5, the holes 9 extend straight. Accordingly, even in the shank 3, the holes 9 are arranged similarly as in the airfoil portion 5. Accordingly, as shown in FIG. 5C, even at a central-level portion of the shank 3 where the deepest depressed portion 6*c* is formed, the holes 9 are arranged along a geometry resembling the horizontal cross-sectional shape of f the airfoil portion 5.

Next, the configuration of adjacent gas turbine moving-blades will be described.

As shown in FIG. 6 to 8, the two gas turbine moving-blades that are arranged adjacent to each other with the spacing 18 formed therebetween are referred to as a "first gas turbine moving-blade 11" and a "second gas turbine moving-blade 21." A groove 17 for accommodating a seal pin 16 is provided on a side surface (with respect to the circumferential direction of a rotary shaft) of the platform 14 of the first gas turbine moving-blade 11. The seal pin 16 accommodated in the groove 17 prevents high-temperature combustion gas, which flows over an airfoil 15 of the first gas turbine moving-blade 11 and over an airfoil 25 of the second gas turbine moving-blade 21, from flowing into a side toward blade root portions 12 and 22, as well as prevents cooling air (cooling medium), which flows through the first gas turbine moving-blade 11 and through the second gas turbine moving-blade 21 for cooling the blades 11 and 21, from leaking from the side toward the blade root portions 12 and 22 to a side toward the airfoil portions 15 and 25. The seal pin 16 assumes the shape of a rod.

The groove 17 of the first gas turbine moving-blade 11 is defined by a first wall 17*a*, which extends inboard of the platform 14 while being directed from a side toward the airfoil portion 15 to a side toward the blade root portion 12; a second wall 17*b*, which continues from the first wall 17*a* and extends downward substantially in parallel with a side wall 14*a* of the platform 14; and a third wall 17*c*, which continues from the second wall 17*b* and extends substantially horizontally to the side wall 14*a* of the platform 14. Even when the seal pin 16 is biased, in the groove 17, toward the blade root portion 12, the seal pin 16 is in contact with the walls 17*a*, 17*b*, and 17*c* of the groove 17 and with a side wall 24*a* of a platform 24 of the second gas turbine moving-blade 21. Accordingly, the adjacent first and second gas turbine moving-blades 11 and 21 do not come in direct contact with each other. Vibration of the first gas turbine moving-blade 11 is propagated to the adjacent second gas turbine moving-blade 21 via the seal pin 16, and vibration of the second gas turbine moving-blade 21 is propagated to the first gas turbine moving-blade 11 via the seal pin 16.

When the first gas turbine moving-blade 11 and the second gas turbine moving-blade 21 are rotatively driven as a result of rotation of the rotary shaft of the gas turbine, centrifugal force directed toward the airfoil portion 15 is imposed on the seal pin 16 accommodated in the groove 17. Accordingly, the seal pin 16 is pressed toward the airfoil portion 15 while being accommodated in the groove 17. At this time, the first and second gas turbine moving-blades 11 and 21 are vibrating. Specifically, the first and second gas turbine moving-blades 11 and 21 vibrate in such a direction as to move toward and away from each other. When, in vibration, the adjacent first and second gas turbine moving-blades 11 and 21 move away from each other, the above-mentioned centrifugal force causes the seal pin 16 to be pressed toward the airfoil portion 15 while being accommodated in the groove 17. When, in vibration, the first and second gas turbine moving-blades 11 and 21 move toward each other, the first and second gas turbine moving-blades 11 and 21 in contact with the seal pin 16 apply force to the seal pin 16 in such a manner as to press the seal pin 16 inboard of the groove 17; i.e., toward the shank 13, against the above-mentioned centrifugal force. Accordingly, while being supported by an unillustrated disk via the blade root portion 12, the first gas turbine moving-blade 11 is also supported by the seal pin 16 interposed between the first and second gas turbine moving-blades 11 and 21.

Therefore, the seal pin 16 and the first gas turbine moving-blade 11 form such an elastic structure that the seal pin 16 having a spring constant $K_1$ supports the airfoil portion 15, the platform 14, the shank 13, and the blade root portion 12, which collectively have a mass $M_1$. The first gas turbine moving-blade 11 can be considered to be a damper having a natural frequency.

In the elastic structure in which the seal pin 16 having the spring constant $K_1$ supports the airfoil portion 15, the platform 14, the shank 13, and the blade root portion 12, which collectively have the mass $M_1$, a natural frequency $f_{m1}$ of the first gas turbine moving-blade 11 can be represented by the following Eq. (1).

$$f_{m1}=(1/2\pi)\cdot\{(K_1)/M_1\}^{1/2} \quad (1)$$

As is apparent from Eq. (1), by means of adjusting the spring constant $K_1$ and the mass $M_1$, the natural frequency $f_{m1}$ of the first gas turbine moving-blade 11 can be determined so as to avoid resonance with vibration of a stationary vane.

As in the case of the above-mentioned first gas turbine moving-blade 11, a plurality of gas turbine moving-blades provided on a rotary shaft can be caused to function as respective dampers so as to avoid the coincidence between the natural frequency of the gas turbine moving-blades and that of stationary vanes, thereby preventing resonance of the gas turbine moving-blades with the stationary vanes.

The above embodiment is described while mentioning a gas turbine moving-blade in which an arcuately depressed portion is provided so as to avoid the coincidence between its natural frequency and that of a stationary vane. However, the present invention is not limited thereto. For example, the present invention may be applied to a moving blade of a steam turbine. Even in this case, actions and effects similar to those mentioned above with respect to the gas turbine are yielded.

What is claimed is:

1. A moving blade comprising:

an airfoil portion to be exposed to high-temperature gas;

a platform for supporting the airfoil portion;

a shank extending downward from the platform;

a blade root portion extending downward from the shank and to be embedded in a rotary shaft;

a cooling air flow path extending through the blade root portion, the shank, the platform, and the airfoil portion for channeling cooling air; and an arcuately depressed portion, formed on the shank, having a depth being greatest at a central portion in a horizontal section of the shank, wherein a shape of a concave pressure side of the air foil portion and the arcuately depressed portion of the shank at substantially the central level of the shank are substantially similar to each other.

2. A moving blade according to claim 1, wherein the arcuately depressed portion extends from a lower end of the platform to the blade root portion.

3. A gas turbine comprising a plurality of moving blades according to claim 2, the moving blades being arranged in a circumferentially adjoining condition on a circumference of each of disks arranged axially on a rotary shaft.

4. A moving blade according to claim 1, wherein the arcuately depressed portion extends from a leading end of the shank to a trailing end of the shank.

5. A gas turbine comprising a plurality of moving blades according to claim 4, the moving blades being arranged in a circumferentially adjoining condition on a circumference of each of disks arranged axially on a rotary shaft.

6. A moving blade according to claim 1, wherein the arcuately depressed portion is formed on the same side as a concave pressure side of the airfoil portion.

7. A gas turbine comprising a plurality of moving blades according to claim 6, the moving blades being arranged in a circumferentially adjoining condition on a circumference of each of disks arranged axially on a rotary shaft.

8. A moving blade according to claim 1, wherein a portion of the shank opposite the arcuately depressed portion is located on the inside of a straight line extending in contact with a side end of the platform and a side end of the blade root portion.

9. A gas turbine comprising a plurality of moving blades according to claim 8, the moving blades being arranged in a circumferentially adjoining condition on a circumference of each of disks arranged axially on a rotary shaft.

10. A moving blade according to claim 1, wherein a lower portion of the shank is rendered flat.

11. A gas turbine comprising a plurality of moving blades according to claim 10, the moving blades being arranged in a circumferentially adjoining condition on a circumference of each of disks arranged axially on a rotary shaft.

12. A moving blade according to claim 1, wherein an edge of the leading end and an edge of the trailing end of the shank on a side where the arcuately depressed portion is formed are chamfered.

13. A gas turbine comprising a plurality of moving blades according to claim 12, the moving blades being arranged in a circumferentially adjoining condition on a circumference of each of disks arranged axially on a rotary shaft.

14. A gas turbine comprising a plurality of moving blades according to claim 1, the moving blades being arranged in a circumferentially adjoining condition on a circumference of each of disks arranged axially on a rotary shaft.

15. A gas turbine comprising;

a plurality of moving blades mounted on a rotary shaft in a circumferentially adjoining condition, each moving blade comprising an airfoil portion to be exposed to high-temperature gas;

a platform for supporting the airfoil portion;

a shank extending downward from the platform;

a blade root portion extending downward from the shank and to be embedded in the rotary shaft;

a cooling air flow path extending through the blade root portion, the shank, the platform, and the airfoil portion for channeling cooling air;

a seal pin provided in a spacing between the shanks of the adjacent moving blades for preventing leakage of cooling air from a blade root portion side to an airfoil side; and an arcuately depressed portion, formed on the shank of each of the moving blades1 having a depth that is greatest at a central portion in a horizontal section of the shank of each of the moving blades, wherein a shape of a concave pressure side of the air foil portion and the arcuately depressed portion of the shank at substantially the central level of the shank are substantially similar to each other, and wherein vibration of each of the moving blades is suppressed in such a manner that the seal pin serves as a spring system while the airfoil portion, the platform, the shank, and the blade root portion serve as a mass system.

16. A moving blade comprising:

an airfoil portion to be exposed to high-temperature gas;

a platform supporting the airfoil portion;

a shank extending downward from the platform;

a blade root portion extending downward from the shank that is to be embedded in a rotary shaft;

a cooling air flow path channeling cooling air and extending through the blade root portion, the shank, the platform, and the airfoil portion; and an arcuately depressed portion formed on the shank on a same side as a concave pressure side of the airfoil portion and extending from a lower end of the platform to the blade root portion, wherein a depth of the arcuately depressed portion is greatest at a central portion in a horizontal section of the shank; and wherein a shape of a concave pressure side of the air foil portion and the arcuately depressed portion of the shank at substantially the central level of the shank are substantially similar to each other.

* * * * *